US007414923B2

(12) United States Patent
Kadokura

(10) Patent No.: US 7,414,923 B2
(45) Date of Patent: Aug. 19, 2008

(54) GRAPHICAL ORGANIZATIONAL TASK TIMER

(76) Inventor: Moschel Kadokura, 21370 Vai Ave., Cupertino, CA (US) 95014

( * ) Notice: Subject to any disclaimer, the term of this patent is extended or adjusted under 35 U.S.C. 154(b) by 276 days.

(21) Appl. No.: 11/378,939

(22) Filed: Mar. 17, 2006

(65) Prior Publication Data

US 2006/0256665 A1 Nov. 16, 2006

Related U.S. Application Data

(60) Provisional application No. 60/662,571, filed on Mar. 17, 2005.

(51) Int. Cl.
*G04B 19/20* (2006.01)
*G04B 19/06* (2006.01)
*G04B 25/00* (2006.01)

(52) U.S. Cl. ..... 368/77; 366/223; 366/233; 434/304

(58) Field of Classification Search ..... 368/10, 368/76, 77, 97, 101, 107–110, 223, 228, 368/229, 232–234, 244; 434/304
See application file for complete search history.

(56) References Cited

U.S. PATENT DOCUMENTS 586,366 A * 7/1897 Kuhn ..... 40/474
2,305,283 A * 12/1942 Theilkas ..... 368/44
D146,757 S 5/1947 Webb ..... D34/15
2,493,138 A * 1/1950 Hathaway ..... 434/304
2,647,330 A 8/1953 Ford ..... 35/39
2,853,804 A 9/1958 Bengeyfield ..... 35/39
3,763,648 A * 10/1973 Pakter et al. ..... 368/41
3,967,389 A 7/1976 Brooks ..... 35/39
4,124,945 A 11/1978 Totten ..... 35/39
4,208,870 A 6/1980 Cullom ..... 368/41
5,044,961 A * 9/1991 Bruskewitz ..... 434/304
5,646,913 A * 7/1997 Quesenberry ..... 368/223
6,361,325 B1 * 3/2002 McGuire ..... 424/304
6,392,963 B1 * 5/2002 McGinnis-Smith et al. . 368/107
6,416,727 B1 * 7/2002 Virtanen ..... 423/432
D500,958 S 1/2005 Cooper ..... D10/126
2003/0210611 A1 * 11/2003 Bloch ..... 368/77
2003/0210613 A1 11/2003 Bloch ..... 368/223

* cited by examiner

*Primary Examiner*—Vit W Miska
(74) *Attorney, Agent, or Firm*—West and Associates, APC; Stuart S. West; Charlotte Rodeen-Dickert

(57) ABSTRACT

A novel graphical organizational timing device is disclosed. The device indicates tasks or events to be completed within a pre-determined routine using customizable and/or changeable discs attached to a mechanical countdown timer. The device is primarily designed for use with children and adolescents but can be used within any setting in which tasks have to be performed in sequence in a pre-set time period.

20 Claims, 10 Drawing Sheets

GRAPHICAL ORGANIZATIONAL TASK TIMER

CLAIM OF PRIORITY

This application claims the benefit of U.S. Provisional Application No. 60/662,571, filed Mar. 17, 2005, the complete contents of which is incorporated herein by reference.

BACKGROUND

1. Field of the Invention

The current disclosure relates to a graphical task timer for timing tasks and a method for using such a timer to teach users, including children and adolescents, to keep to a routine and to perform certain tasks according to a pre-determined routine.

2. Background

Children and adolescents growing up often have problems managing their time. They often lack the discipline or sense of time to manage their daily routines, resulting in ignored chores and missed schedules. A common example is the morning routine, when a child has to get up in time and perform morning chores such as making the bed, taking a shower, brushing her teeth, getting dressed, have time for breakfast, and leave on time to catch the transportation to school. Often, the child develops a bad habit of running late every morning, resulting in constant nagging by the parents and a tense atmosphere in the household.

Indeed, many parenting experts have stressed the importance of establishing routines for young children to help them make daily transitions smoothly. These include the morning transition from home to school, the afternoon transition from school to after-school activities and home, and the evening transition from evening activities to bedtime. Establishing routines gives children a firm structure and routine to follow, and gives them the security in knowing what is expected of them. By helping children stay on-task, they can perform their activities independently without constant supervision or reminders, thus building self-esteem and self-reliance.

However, what often happens is children will deviate from their given routines and chores will be rushed, performed half-heartedly or skipped, requiring constant parental supervision or reminders. What is needed is a method to assist the children in monitoring their own progress during the fixed routine, and to help them develop good time-management skills.

A number of prior art devices have been developed to aid children in learning and adhering to a routine. U.S. Pat. No. 5,044,961 to Bruskewitz teaches a simple timer for teaching young children the concept of time. The timer includes a timing mechanism contained within a housing having a timer dial and activity selector. The timer dial permits selection of a duration of predetermined length and includes an indicator which moves in relation to a time scale to graphically illustrate the change in duration of length. The activity selector permits display of a graphic representation of the activity being timed or for which the child is waiting. However, only one activity symbol is ever shown in the window at any one time, and the activity symbol remains in a stationary position throughout the timed period. The shortcoming of this device in teaching time-management skills is that it doesn't relate individual activities and tasks to an overall routine, and timer can only time one activity before it has to be reset to time another.

U.S. Pat. No. 6,416,216 B1 to Haughey teaches a system to aid children or others in managing and understanding the concept of time and in remembering scheduled events. The disclosed event clock visually demonstrates the time during which at least one predetermined event is scheduled to occur. The event clock includes a timing mechanism, an indicator operatively connected to the timing mechanism, and preferably several event markers. Each event marker visually symbolizes a scheduled event and is disposed in relation to the indicator such that the indicator provides a signal during the time the event is scheduled to occur. The device disclosed comes configured with twelve event markers slots for holding event markers.

The Haughey device has a number of short-comings in teaching time management skills. One, the timed period is pre-divided into twelve event marker slots, with each slot representing 5 minutes or 10 minutes, depending on the timer used. However, this makes it difficult to use the device to schedule a larger number of events than twelve, or to schedule events that only occur for a short duration (for example, a number of events that only take one or two minutes). Further, the time indicator doesn't indicate the progress of the user in respect to the entire routine. If the user runs late with one task, the device offers no assistance on how the user might get back on track.

What is desired, therefore, is a device that is easily customizable for any fixed routine, and can assist a user on developing a good habit of performing set tasks on time.

What is also desired is a device that is simple to operate and understand, and can be adaptable for use for any age group from young children, to adolescents and even adults.

The device should be configurable for timing different pre-determined periods, including one hour and two hour intervals. The device should also be easily configurable to handle any number of events, even if the events are of short duration.

It is also desired that the device shows clearly "past-due", "do it now" and "upcoming" time segments, to teach the user time management skills in how to deal with running late or running early in their routine.

It is further desired that a method for teaching time-management skills using this novel device be made available.

SUMMARY OF THE INVENTION

The present disclosure is for a novel graphical organizational timing device. The device indicates tasks or events to be completed within a pre-determined routine using customizable and/or changeable discs attached to a mechanical countdown timer. The device is primarily designed for use with children and adolescents but can be used within any setting in which tasks have to be performed in a sequence in a pre-set time period.

DETAILED DESCRIPTION

Figure 1:
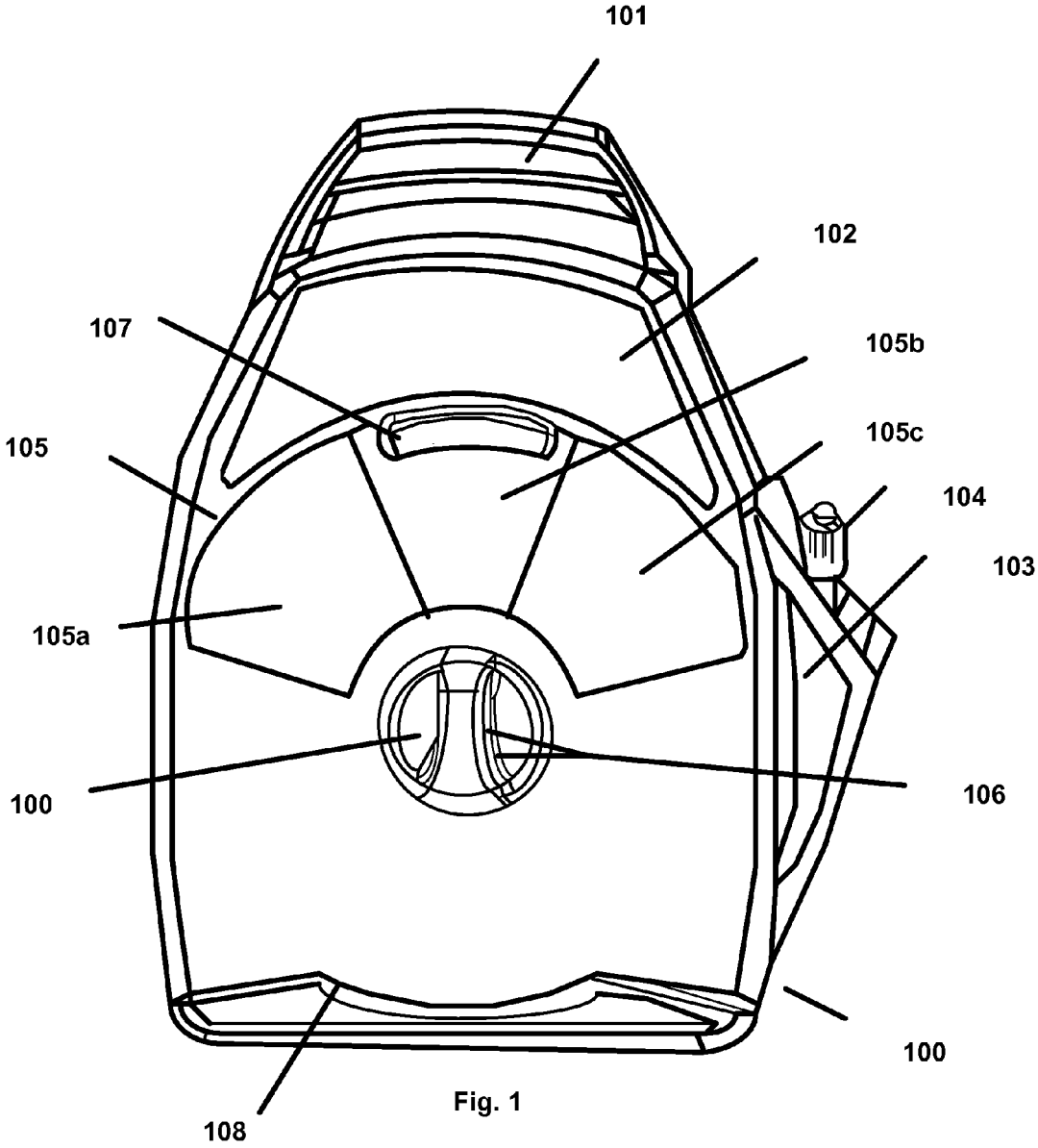
FIG. 1 depicts a front view of the base unit according to one embodiment of the device.

FIG. 1 depicts the front view of an embodiment of the graphical organizational timing device 100. The base has a handle 101 for easy carrying, and it is designed to stand independently. The base unit can be constructed of any sturdy material known or convenient, including plastics, metals, wood and FRP. In the embodiment depicted, the base unit has a dry-erase writing area 102 (what is commonly called a "white board") constructed of Porcelain steel or any compatible material known or convenient. The material chosen should also be useable with magnets for holding notes. A storage bin 103 for dry-erase pens 104 is also provided, for easy writing and erasing of notes that pertain to the day's routines.

Disposed below the writing area 102 is a progress indicator display 105. The progress indicator is to be used in conjunction with a routine disc, described in detail below. In a preferred embodiment, the progress display indicator is divided into three segments 105*a*, 105*b* and 105*c*. The segments represent, from left to right, "completed", "do it now" and "upcoming" time segments. The segments can be color-coded for easy reference, for example, using the color red for segment 105*a*, green for 105*b* and yellow for 105*c*. Any combination of colors or labels are possible, as long as they depict "past", "present" and "future" time segments.

The progress indicator display 105 gives a easy-to-view graphical indicator of where the user stands currently with respect to the rest of the routine. It gives the user a quick visual confirmation of tasks: Tasks that should already be completed at the present time is highlighted in red, the current task the user should be performing is highlighted in green, and upcoming tasks are previewed by highlighting them in yellow. An overall view of the tasks in sequence is an important part of developing good time management skills. This gives older children and advanced users a degree of time-management planning if they should run late or run early in the schedule. By giving a graphic representation of tasks in sequence, the user can plan accordingly and speed up or slow down some tasks as time permits. Of course, younger users and beginning users should be encouraged to "stick to the routine" and perform a task when the task is in the "do it now" time segment.

Disposed in the center of the lower portion of the base unit is a rotational timer knob 106. The timer knob 106 is connected to a shaft 702 that passes through the front of the base unit and is connected to a mechanical timer device 701 connected to the back of the base unit (see FIG. 7 below). The timer knob 106 serves a number of purposes: First, it is used to set the mechanical timer device 701. By grasping hold of the timer knob 106 and turning it clockwise, the mechanical timer device 701 is wound and set. In turn, the mechanical timer device 701 drives the knob to rotate in a counter-clockwise direction through the connecting shaft 702. (Note in the embodiment discussed herein, the mechanical timer runs counter-clockwise and the tasks on the routine disc are arranged accordingly. This is arbitrary and a timer that runs clockwise can be chosen.) In a preferred embodiment, the knob will complete one full revolution in one hour. Longer or shorter time periods may be set by adjusting settings on the mechanical timer, or by switching out and replacing the timer itself.

Figure 2:
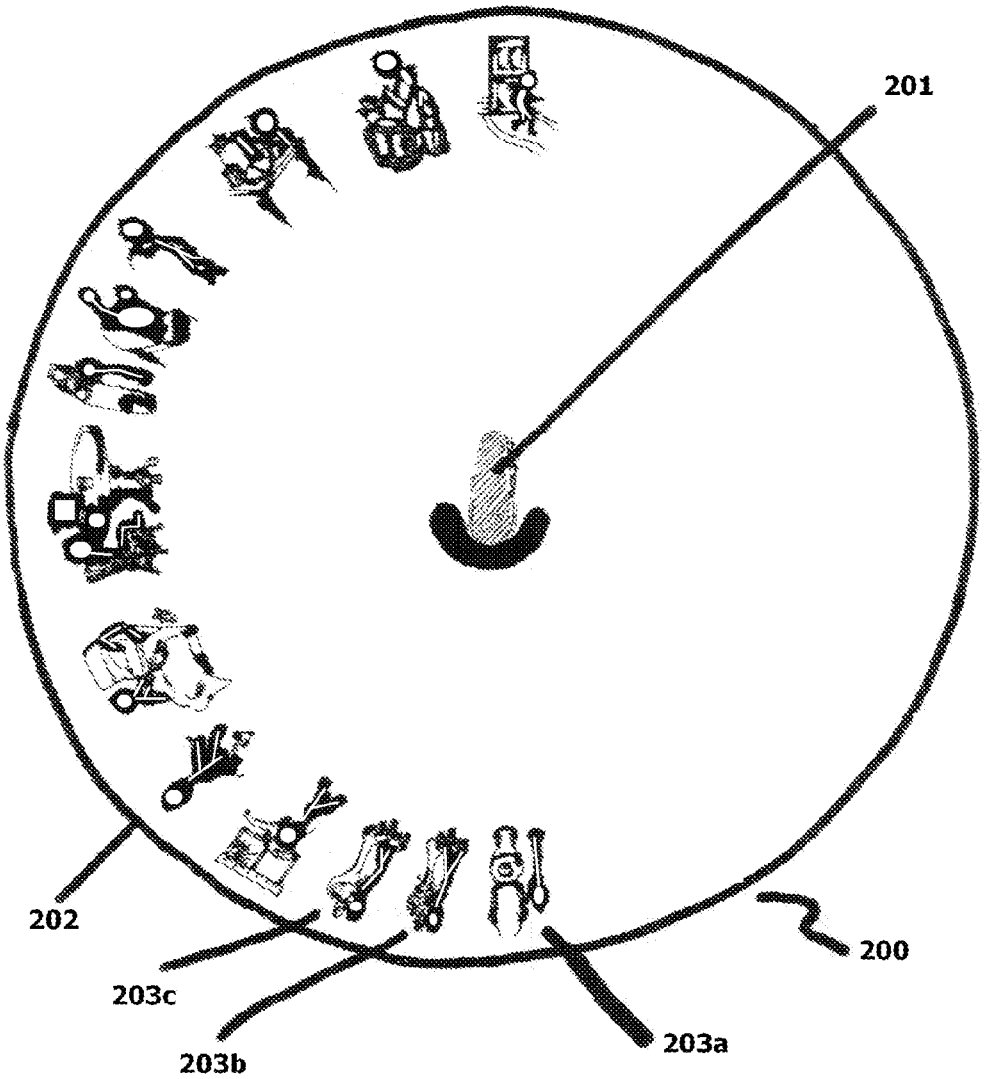
FIG. 2 depicts an example of a routine disc depicting a morning routine.

A second purpose of the knob is to serve as a receptacle to receive a routine disc (see FIG. 2). Note that it is not a primary purpose of the knob to serve as a pointer to indicate what task the user should be currently performing. That task is served by the routine disc.

In the embodiment depicted in FIG. 1, the rotational timer knob 106 is tapered to be thicker at one end and thinner at the other, to give a visual indication that the timer ends when the thinner end points directly up. Any other convenient arrangement such as a label or a pointer will also suffice. The timer knob 106 has raised grooves 106*a* to act as a receptacle to receive at least one routine disc 200 (see FIG. 2). This uniquely shaped handle is keyed to the routine disc so that the routine disc can only be mated to the base in the correct end position. This is critical because the routine disc must be placed so that the end task is placed in the "0" minutes remaining position before the timer is set.

Figure 3:
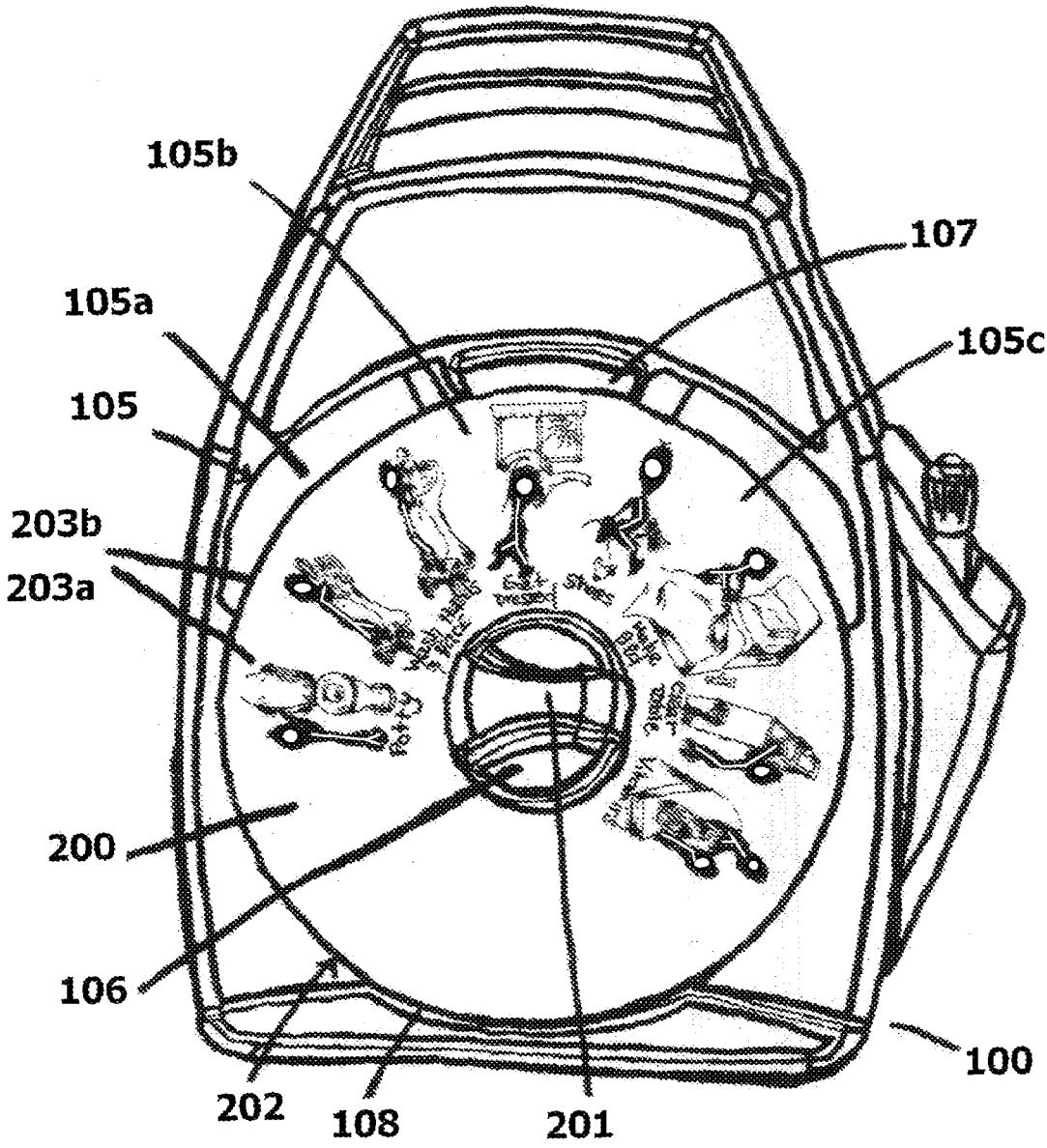
FIG. 3 depicts a front view of the base unit with a routine disc affixed.

FIG. 2 depicts a sample routine disc 200 according to an embodiment of the invention. In the center of the disc is an opening 201 that is of a shape that corresponds to the raised grooves 106*a* of the timer knob 106, allowing the routine disc 200 to be removably mated to the timer knob 106, as depicted in FIG. 3. In a preferred embodiment, the discs are made of a transparent or translucent material so that when affixed to the base unit 100, the progress indicator 105 can be clearly viewed and highlights the given task in color. The transparent or translucent material can be chosen from any material known or convenient, including plastic film and thin plastic. In an alternate embodiment, the discs can be non-transparent (for example, when customized pictures are used). In that case, the discs should be made a bit smaller so that at least part of the progress indicator 105 will be visible and not be obstructed by the disc.

By making the routine discs different in size, two or more routine discs can be overlaid on top of each other in concentric circles to show two or more sets of routines. By affixing the routine discs to the base unit, two or more routines that run simultaneously (or at least occur within the same time period) can be timed for two or more users.

FIG. 3 shows the front view of the device 100 with a routine disc 200 affixed. As discussed above, the routine disc 200 is affixed to the timer knob 106 thorough the opening 201 in the disc's middle, which mates with the raised groove receptacle 106*a* of the timer knob 106. The outer edge 202 of the routine disc 200 can received by disc guides 107 and 108 to ensure that the routine disc 200 can rotate smoothly as it is rotated by the timer knob 106. As shown in FIG. 3, the progress indicator 105 can be seen through the transparent routine disc 200, and highlights in color tasks falling in the "completed" 105*a*, "do it now" 105*b* and "upcoming" 105*c* time segments.

Figure 4:
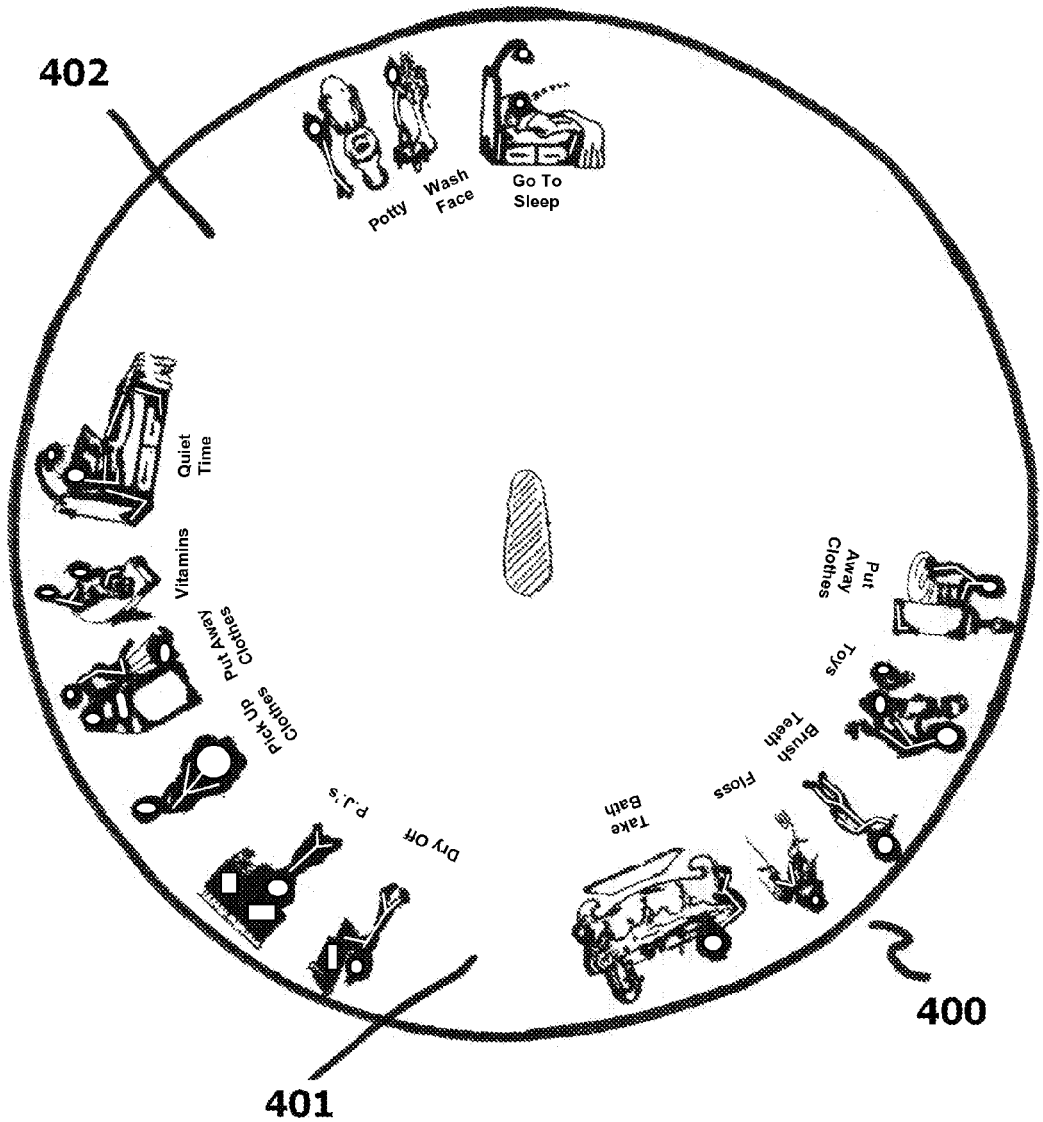
FIG. 4 depicts another example of a routine disc, depicting an evening routine.

The routine discs are customizable to graphically represent any pre-determined routine with the use of task stickers that show graphical representations or labels of different tasks. By lining up task stickers in sequence and spacing them according to the time each task will require, individual tasks that make up a routine are laid out on a routine disc. For example, the disc as depicted in FIG. 2 shows, with task stickers 203*a*, 203*b*, 203*c*, etc; a morning routine that has to be completed within thirty (30) minutes. FIG. 4 shows another example of a routine disc 400 which depicts an evening routine that has to be completed within forty-five (45) minutes. Note that in the example depicted in FIG. 4, empty slots 401 and 402 represent breaks in the schedule, in which the previous activity ("Bath/Shower" and "Quiet Time" respectively) can be allowed to extend into, or the user can engage in another activity before the next required task has to be performed.

In one embodiment of the device, the task stickers are transparent to allow the progress indicator display 105 to be seen through the routine disc. The stickers should be removable to allow for repositioning and re-use. In alternate embodiments, tabs using Velcro® or magnetic attraction means can be used to attach task tabs to the routine disc.

Figure 5:
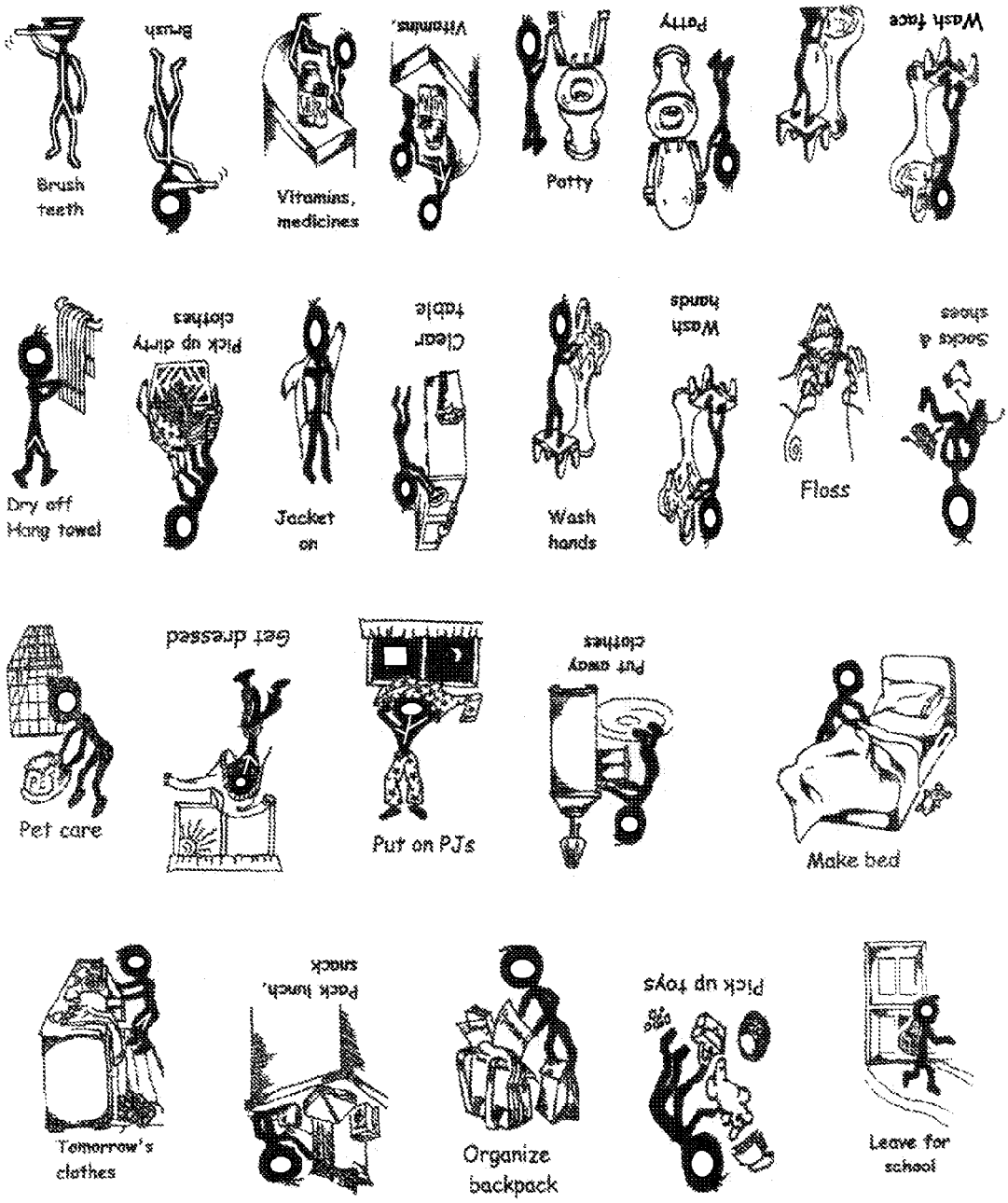
FIG. 5 & FIG. 5*a* depicts sample of stickers with graphical representations of tasks for use with customization of a routine disc.
Figure 5A:
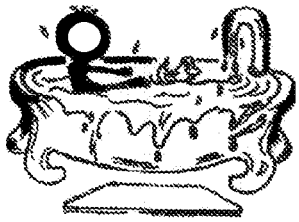
Figure 5A:
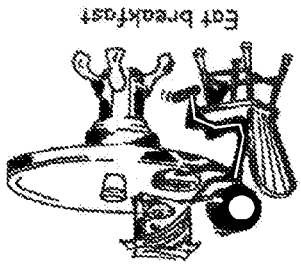
Figure 5A:
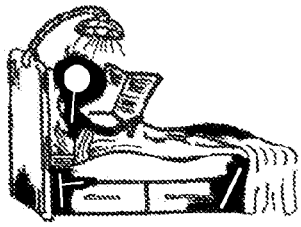
Figure 5A:
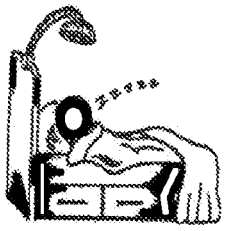
Figure 6:
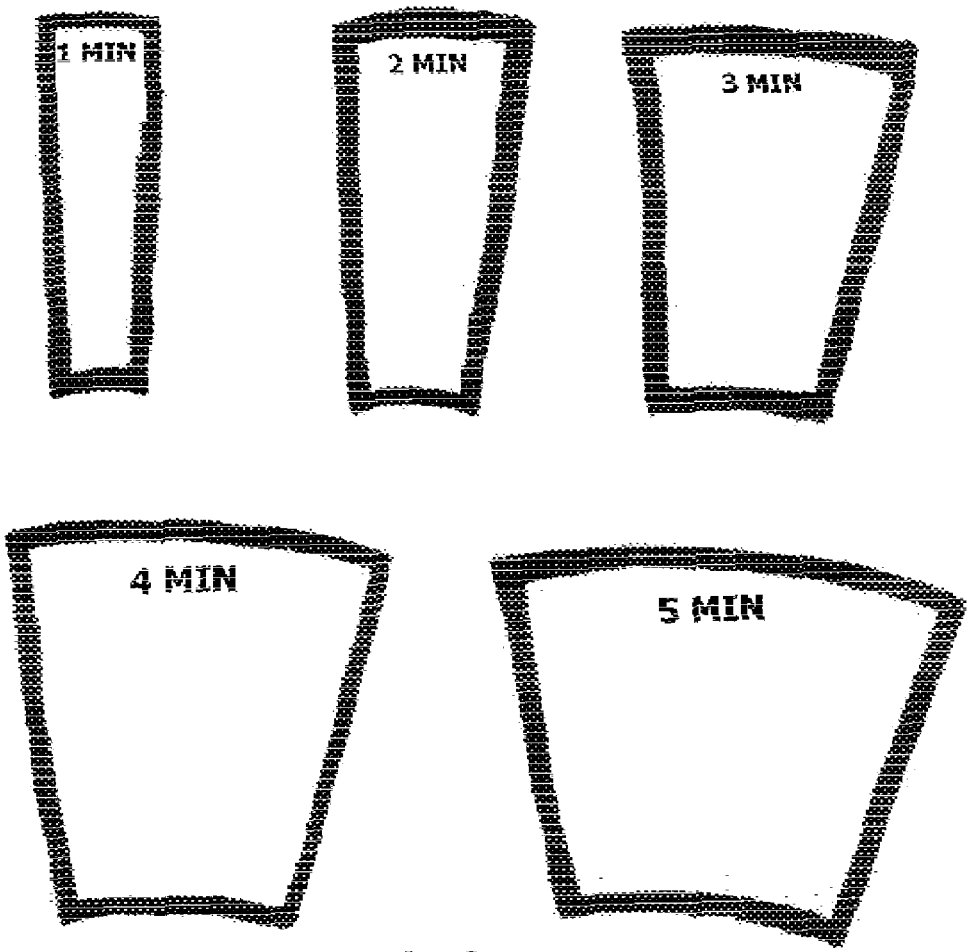
FIG. 6 depicts templates for sizing blank stickers for customizing a routine disc.

Examples of pre-printed task stickers with graphical representations and labels for everyday tasks are shown in FIG. 5 and FIG. 5*a*. The graphical representations in FIGS. 5 and 5*a* are meant as being illustrative and are not limiting on the disclosure. Any graphical representation can be used, including cartoon figures, symbols, and text, as long as they serve the purpose of reminding the user what the required task is. Sheets of blank stickers can also be provided, so that the user can draw or write on them with a permanent marker to depict tasks not depicted by the pre-printed task stickers. Templates (not to scale) for blank stickers for depicting tasks that has to be performed in 1, 2, 3, 4 and 5 minutes are shown in FIG. 6.

Figure 6A:
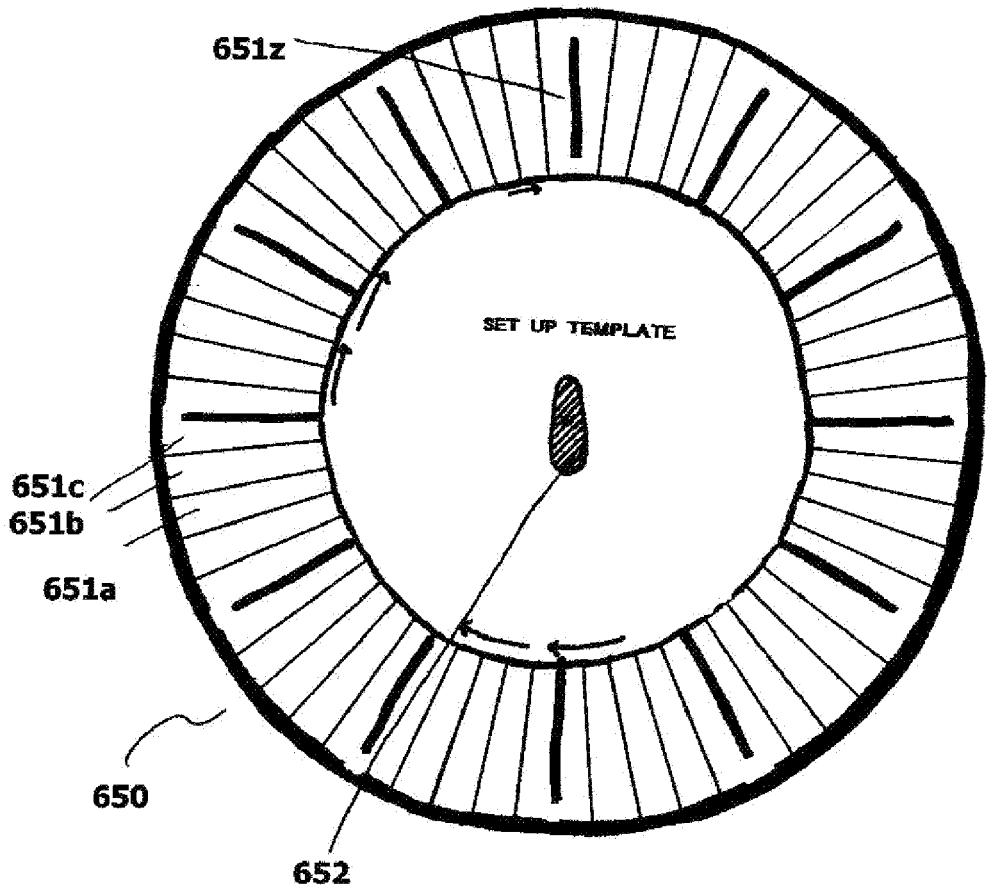
FIG. 6*a* depicts a template disc for setting up a routine on a routine disc.

In order to properly create an accurate customized routine, stickers need to be affixed onto the routine disc in proper locations that correspond to their proper order in the routine and how much time each task requires. To assist in proper placement of the task stickers in the routine disc, a template disc 650 as depicted in FIG. 6*a* can be used. The template disc also has a central opening 652 that is keyed to the timer knob 106, so that a routine disc (with the same keyed central opening) can be properly lined up with it. In the exemplary template disc shown, segments in one-minute intervals 651*a*, 651*b*, 651*c*, etc., are clearly marked along the outer circumference of the template disc. A segment 651*z* showing the "final event" is marked with the time segment "0". Time segments for "Beginning Tasks", "Working Throughout the Routine", "Almost Ready" and "Final Event" are marked for easy visual confirmation of the ordering of events.

Using the template disc 650 as a guide, the task stickers can be easily be affixed on proper locations on a routine disc. In a preferred embodiment of the device, the routine discs are transparent, making it a simple matter to overlay the routine disc over the template disc in order to see the time segments. Note for tasks requiring longer than 5 minutes, an empty space can be left on the space following that task (see, for example, the routine disc in FIG. 4). Once the routine is set up, the template disc 650 can be set aside, and there is no need to use the template disc with the base unit during the timed routine. It is preferred that the routine discs themselves do not depict time segments, and be kept as simple as possible so that even a young user can clearly view and understand the tasks set up on it.

In a further embodiment of the device, software that allows for individual user customization can be included. The software would allow, for example, pictures or name of the child user to be printed on the stickers. This helps the child user to feel engaged with using the device. Further, the software can create and print out a routine disc simply by having a user input the sequence of tasks and the time required, eliminating the need for measuring and placing stickers on the disc.

Figure 7:
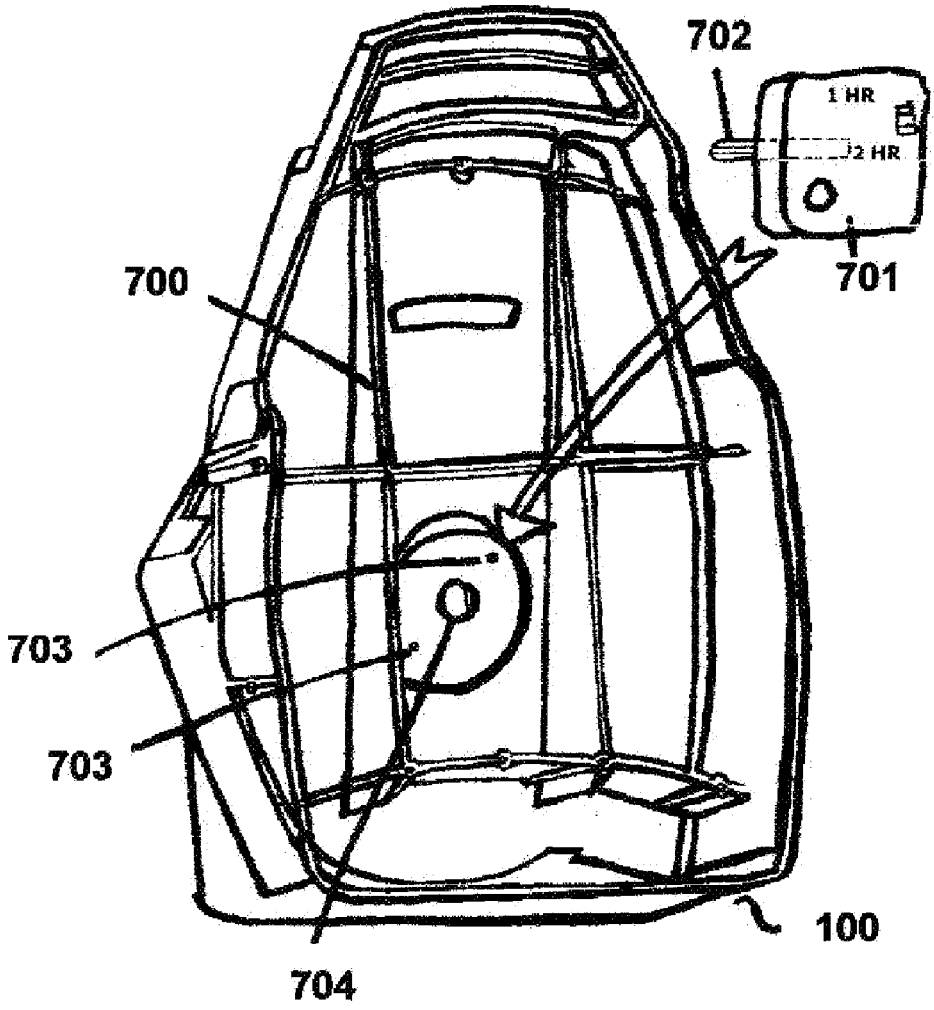
FIG. 7 depicts a back view of the base unit and the mechanical timing device.

FIG. 7 shows the back of the device depicted in FIGS. 1 & 3. The back shows a system of structural reinforcements 700 and mounts 703 for mounting a mechanical timing device 701. The timer device 701 drives a shaft 702 which passes through an opening 704 in the base 100 and connects to and rotates the rotational timer knob 105 at the front of the base. In an embodiment of the device, the mechanical timing device 701 has a switch that can switch the device between one hour and two hour timing modes, in which one complete revolution of the rotational knob 105 corresponds to one hour and two hours, respectively. In a preferred embodiment of the device, the timer used should give an audible signal such as a chime or a buzz when the time runs out. In alternate embodiments, the audible signal can be digitized speech or music, and may be recordable by the user.

Figure 8:
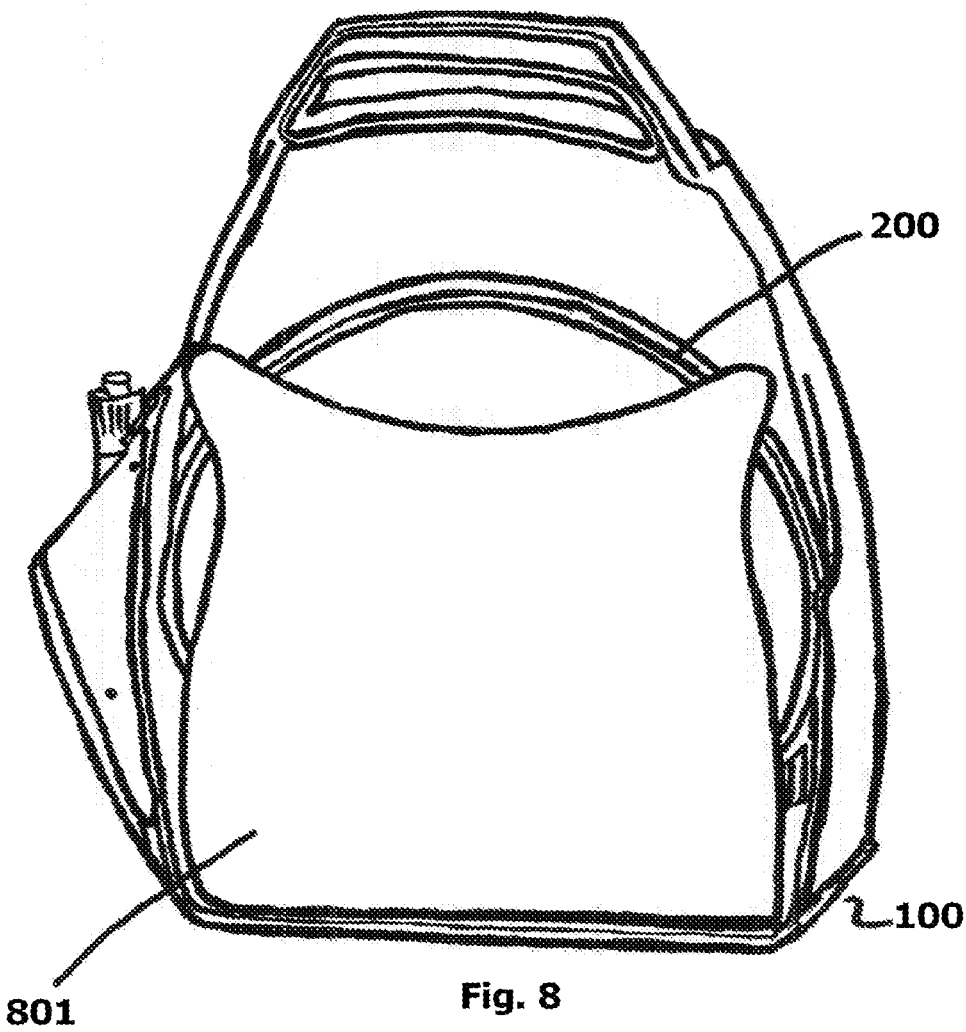
FIG. 8 depicts a back view of the base unit with the storage cover for routine discs in place.

FIG. 8 shows the back of the device with a removable cover 801 attached. The cover also acts as a storage bin for additional routine discs 200.

Finally, a method for using the device as described above for training a user to adhere to a given routine and to develop good time management skills is disclosed. An adult supervisor should first observe how long the child will take to run through the needed tasks. Involve the child in setting up the routine. The adult should have an idea about what tasks, the order, and the amount of time it should take to complete the routine, but the child may have some very valid ideas on how to make the routine successful. Plus, the child is more likely to follow the routine if he or she has an active role in setting it up.

Preferably, routines should last no longer than forty-five minutes. The younger the child, the shorter the routine and fewer the tasks should be. Be realistic when setting up the routine discs, keeping in mind each child's limitations can be different.

Once a workable routine has been set, a routine disc can be customized using task stickers or with the customized software as discussed above. The device is not meant to be used all hours of the day or intrude on the natural spontaneity of young children. It is not meant to rush a child or to speed up tasks that the child requires a certain amount of time to complete. It is not meant to be an authority over children, but rather, a friendly aid and reminder that the children will enjoy using.

Spend some time observing the child performing the routine with the aid of the device. If the child falls behind in the routine, gently remind her to pay attention to the timer device more often. Tweaks to the routine disc may be necessary to adjust for the child's needs, unforeseen difficulties in sticking to the routine, or simply to make the routine easier to follow. Once the child is comfortable with using the device and performing tasks in the routine on time, less and less supervision is needed until the child can be left unsupervised to carry out the routine. A system of rewards can be incorporated in conjunction with the use of the device, giving a child added incentive to complete chores on time.

Using similar principles as disclosed above, the device can be adaptable for use in a variety of situations involving timing of a fixed routine. For example, routine discs with recipes for cooking can be made. These discs can aid a novice chef in preparing ingredients and time how long the meal has to be cooked. Similarly, the routine disc can be adapted as an aid for studying and preparing standardized tests such as the SAT, PSAT, GMAT and the Examination for Registration to Practice in Patent Cases before the USPTO. The device can be used as an aid for the person studying for a test, wherein a certain number of questions have to be completed by a certain time in order for the person to achieve a passing grade. Other applications are possible using the principles outlined herein.

Although the device has been described in conjunction with specific embodiments thereof, it is evident that many alternatives, modifications and variations will be apparent to those skilled in the art. Accordingly, the device as described and hereinafter claimed is intended to embrace all such alternatives, modifications and variations that fall within the spirit and broad scope of the appended claims.

What is claimed is:

1. An organizational timer for timing tasks in a routine, comprising:

a base unit, said base unit housing a timer device, a routine disc, said routine disc displaying a set of tasks to be performed, means for affixing said routine disc to the timer device, such that the timer device can rotate the routine disc to indicate the passage of time, an indicator on said base unit depicting past, present and future time segments, said indicator indicating the time for performing the tasks on the routine disc.

2. The organizational timer of claim 1, wherein the routine disc is transparent.

3. The organizational timer of claim 1, wherein the routine disc is customizable for routines comprising at least one task to be completed within a fixed time period.

4. The organizational timer of claim 1, further comprising software to create customized routine discs, wherein said software accepts input for tasks, an order said tasks have to be performed in, a duration for completing all tasks, and said software creating a customized routine disc.

5. The organization timer of claim 1, wherein the timer is mechanical.

6. The organizational timer of claim 3, wherein the customization is performed by means of stickers.

7. The organizational timer of claim 6, wherein said stickers are reusable.

8. The organizational timer of claim 7, wherein said stickers are transparent.

9. The organizational timer of clam 1, wherein said routine discs are pre-configured for set routines.

10. The organizational timer of claim 9, wherein said set routine is a recipe for cooking.

11. The organizational timer of claim 10, wherein said set routine is taking a standardized test.

12. The organizational timer of claim 4, wherein said software can create a customized routine disc with a user's pictures.

13. The organizational timer of claim 1, wherein said timer device can time routines of one hour and two hours.

14. The organizational timer of claim 1, wherein said timer device gives an audible signal when the time runs out.

15. The organizational timer of claim 1, further comprising a writing tablet for the writing of notes.

16. The organizational timer of claim 3, wherein the customization is performed by means of tabs.

17. The organizational timer of claim 16, wherein the tabs are held in place on the routine disc by Velcro or magnetic means.

18. The organizational timer of claim 1, further comprising at least one additional routine disc that displays a different set of tasks to be performed from said routine disc, at least one additional routine disc said routine disc and said additional routine disc overlying each other, said routine disc and at least one additional routine disc being used to time different routines that occur within the same time period.

19. The organizational timer of claim 18, wherein said routine disc and at least one additional routine disc are different sized concentric circles.

20. A method for assisting a user to develop time-management skills, comprising the steps of:

a supervisor observing the user in the performance of needed tasks, the supervisor developing a pre-set routine incorporating said needed tasks and an order said tasks have to be performed, providing an organizational timer device to the user, said organizational timer device comprising a base unit, said base unit housing a timer device, a routine disc, means for affixing said routine disc to the timer device, such that the timer device can rotate the routine disc to indicate the passage of time, an indicator on said base unit depicting past, present and future time segments, said indicator indicating the time for performing the tasks on the routine disc, the supervisor creating a customized routine disc according to the routine developed for the user;

educating the user in the user of the organizational timer device in timing the performance of the user's routine, monitoring the user until the user can be self-reliant with the organizational timer device to perform the routine on time.

* * * * *